United States Patent [19]

Francis

[11] 4,077,574

[45] Mar. 7, 1978

[54] IMPACT PULVERIZING MILL WITH AN ATTRITION CHAMBER AND A VERTICAL AIRFLOW CLASSIFICATION CHAMBER

[75] Inventor: Peter M. Francis, Las Vegas, Nev.

[73] Assignee: Industrial Mining Machinery Company, Las Vegas, Nev.

[21] Appl. No.: 676,478

[22] Filed: Apr. 13, 1976

[51] Int. Cl.[2] ..... B02C 23/30

[52] U.S. Cl. ..... 241/52; 241/79.1; 241/80; 241/194; 241/285 B

[58] Field of Search ..... 241/52, 55, 58, 59, 241/79, 79.1, 80, 189 R, 194, 239, 275, 285 A, 285 B

[56] References Cited

U.S. PATENT DOCUMENTS

| | | | |
|---|---|---|---|
| 529,874 | 11/1894 | Parker | 241/55 |
| 1,231,478 | 6/1917 | Blankmann | 241/189 R |
| 1,469,877 | 10/1923 | Blum | 241/59 |
| 1,570,037 | 1/1926 | Blum et al. | 241/59 |
| 2,152,108 | 3/1939 | Tice | 241/55 |
| 2,392,958 | 1/1946 | Tice | 241/55 |
| 3,545,690 | 12/1970 | Burian | 241/285 B |
| 3,857,519 | 12/1974 | Schafer et al. | 241/239 |
| 3,887,141 | 6/1975 | Francis | 241/52 |

*Primary Examiner*—Granville Y. Custer, Jr.
*Attorney, Agent, or Firm*—Herbert C. Schulze

[57] ABSTRACT

A mill for the pulverizing and classification of particles utilizing an impact rotor to obtain the reduction of large chunks and particles of materials by impaction between lining plates and hammers mounted on the rotor. The lining plates are mounted on adjustable walls of an impact reduction chamber in a position to be impacted by the particles thrown from the impact rotor hammers. Particles are then carried by vertical air flow into vertically stacked classification chambers which are located directly above the attrition chamber. Gravity and deflector plates cause the return of some of the particles which receive a secondary impact with the impact rotor producing a continuous interchange of particles and resulting in the autogenous attrition of the particles between the rotor and lining plates. Another feature of the present invention is the utilization of a "fluidizer" to maintain the flow of particles which accumulate at the bottom of the impact reduction chamber.

5 Claims, 10 Drawing Figures

IMPACT PULVERIZING MILL WITH AN ATTRITION CHAMBER AND A VERTICAL AIRFLOW CLASSIFICATION CHAMBER

CROSS REFERENCE TO RELATED PATENT APPLICATIONS

Previous filing includes U.S. Pat. No. 3,887,141, issued June 3, 1975 for IMPACT-ATTRITION MILL UTILIZING AIR FLOW Ser. No. 397,662, filed Sept. 17, 1973, and a continuation in part titled AUTOGENEOUS IMPACT AIR MILL Ser. No. 580,988, filed May 27, 1975 by Peter M. Francis, et al, now abandoned and my application, titled ROTARY MILL UTILIZING AN IMPACT REDUCTION CHAMBER AND A VERTICAL AIR FLOW CLASSIFICATION CHAMBER, Ser. No. 676,477, filed Apr. 13, 1976 filed simultaneously with this application.

BACKGROUND OF THE INVENTION

1. Field of the Invention

This invention is in the general field of a pulverizing mill and is also directed to an impact-classification mill wherein the particles are disintegrated by impact between the material and an impact rotor unit. In the removal of desirable minerals from waste materials in a given particle, it is frequently necessary to reduce the raw size of the chunks by a multistep reduction process. Furthermore it is frequently necessary to obtain a relatively uniform final particle size for a various concentration whereby the desirable materials are separated. The processes associated with the crushing, milling, discharge, and classification of particles require an enormous amount of labor with the result being a substantial labor cost at the location of the deposits. Also, each of the processes is relatively power intensive resulting in a high power expenditure. Furthermore, for each step in the process the abrasive and impacting forces associated with the reduction of the particles produces a high wear condition, resulting in considerable down time for the machinery, and the expensive replacement parts.

2. Description of the Prior Art

There have been a number of various types of mills available in the past for the use in reduction of particles. Such mills have been in use in the past and are primarily directed to crushing and the like, without the reference to up-grading of the mineral classifying function. Because of the deficiencies of prior art reduction processes various approaches have been proposed, whereby the process of crushing, milling, and classification can be accomplished in a single machine. However, previous prior art devices have failed to provide for sufficient reducing force in conjunction with a device that provides adequate control over the finally reduced product, so that a uniform classified size may be consistently produced. One of the great deficiencies has been a tendency of material to pack in the bottom of the impact reduction chamber. This has been cured in the present invention by the use of a "fluidizer". It is therefore desirable to have a reduction mill which combines the functions of crushing, milling and classification in a single housing and with a single drive motor. Such a mill is particularly desirable if the wearing parts of the mechanism are inexpensive, and easily replaced, and if positive control over the final particle size is available.

Of importance is an octagon like shape of the interior of the reduction chamber where the lining plates are located. The walls, in line with the feed chute, can be adjusted so as to regulate the space between the rotor hammers and the lining plates. Also, the reduction chamber housing includes built in hydraulic jacks and is so designed that the chamber can be opened for unlimited access.

SUMMARY OF THE INVENTION

In the reduction of particles, for the many purposes, it is customary to crush by means of ball mills, jaw crushers, and the like, and thereafter to pass the material thus crushed in to various settling tanks and other classifying apparatus. We have now developed, however, in a single mill, a reduction mill which can reduce particles to a very fine grain size, and at the same time, by means of appropriate air flow can actually classify and upgrade the particles thus crushed, and in this manner reduce the ultimate number of steps required to get maximum and economic removal.

An exemplary embodiment of the invention comprises a mill in a single housing. An impact reduction chamber is fed the raw material with variable particle sizes up to and including chunks on the order of one foot in diameter. An impact rotor is positioned within the impact reduction chamber and secured to the output shaft of a drive motor. The impact rotor mounts a plurality of elongated hammer heads around its periphery. The hammer heads are oriented parallel to the rotational axis of the impact rotor. The rotor is positioned so that the particles, falling under the influence of gravity, are tangentially directed against the hammer heads, as the hammer is in the downward mode of travel, and repelled therefrom with great force against the lining plates in the impact reduction chamber. In the impact zone, within the impact reduction chamber, adjustable walls are lined with the lining plates and the lining plates contain projecting edges which reduce the already impacted material to a finer particle size. The reduction particles fall to the bottom of the chamber and are swept, as they reach a predetermined depth, by the continuous rotation of the impact rotor toward a fine particle outlet.

Classification of particle sizing is achieved in vertically stacked classification chambers in the classification area of the mill, located above the impact reduction chamber. Each classification chamber will contain a specially designed diverter plate and a cooperative outlet chute. Particle sizing is achieved by the velocity of air in the classification area since lighter particles will be deflected into the upper chambers and heavier particles will be deflected into the lower chambers. Air flow velocity will be controlled by the amount of air entering the air inlets and the revolution per minute of the impact rotor. Direction of vertical air flow can be regulated by air deflector flaps within the classification chambers.

The impact reduction chamber contains a housing assembly which can be opened, in a jaw like fashion, by the use of built in hydraulic jacks. This method will allow unrestricted access to the interior of the impact reduction chamber.

An attrition chamber, containing deflector plates, is located directly above the impact reduction chamber and directly below the classification chamber.

It is therefore an object of the invention to provide a new and improved impact-classification mill utilizing vertical air flow.

It is another object of the invention to provide a new and improved impact-classification mill which crushes, mills, and classifies particles within a single housing.

It is another object of the invention to provide a new and improved impact-classification mill wherein it is now practical to mill a deposit which was previously catagorized as uneconomical to mill.

It is another object of the invention to provide a new and improved impact-classification mill with a high power efficiency.

It is another object of the invention to provide a new and improved impact-classification mill with adjustment of the discharged fine particle size.

It is another object of the invention to provide a new and improved impact-classification mill which is relatively low in initial cost.

It is another object of the invention to provide a new and improved impact-classification mill which is relatively simple in construction.

It is another object of the invention to provide a new and improved impact-classification mill which may be used for concentration of gold ore.

It is another object of the invention to provide a new and improved impact-classification mill utilizing control over the vertical air flow as a means of controlling final particle size.

It is another object of the invention to provide a new and improved impact-classification mill wherein the aerodynamically designed impact rotor acts as an air blower.

Another object of this invention is to provide a new and improved impact-classification mill wherein a fluidizer is provided to prevent packing of materials within the primary reduction chamber.

Another object of this invention is to feed material tangentially to the impact rotor hammers so that hammer wear will be greatly reduced.

Another object of this invention is to provide vertically stacked classification chambers whose outlet chutes can be positioned in any of four directions and whose outlet chutes contain screens that can be angularly adjusted.

Another object of this invention is to control internal air velocity by controlling impact rotor revolutions per minute and by controlling volume of air entering the air inlets.

Another object of this invention is to control the direction of air flow within the classification chambers by the use of air deflector flaps.

It is another object of this invention to provide an octagon like shaped impact reduction chamber containing an adjustable wall.

It is another object of this invention to provide built in hydraulic jacks in the reduction chamber housing in order to provide unlimited access to the interior of the impact reduction chamber.

Another object of this invention is to provide an attrition chamber directly above the impact reduction chamber and directly below the classification chamber.

Other objects and advantages of this invention will become apparent to those skilled in the art upon reading the description of a preferred embodiment which follows, in conjunction with a review of the appended drawings.

DESCRIPTION OF A PREFERRED EMBODIMENT

Figure 1:
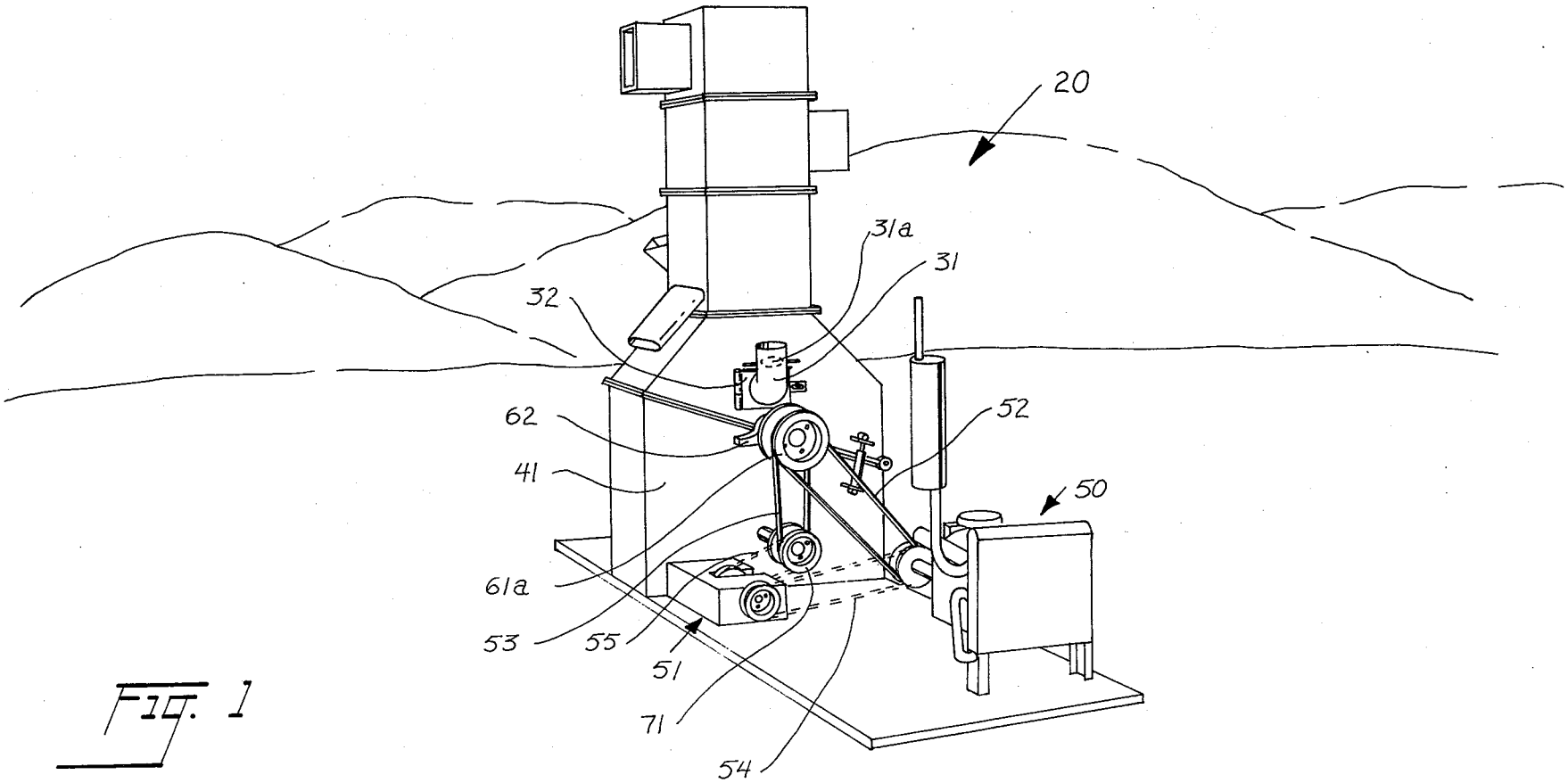
FIG. 1 is a perspective view of a mill showing one type of housing.
Figure 2:
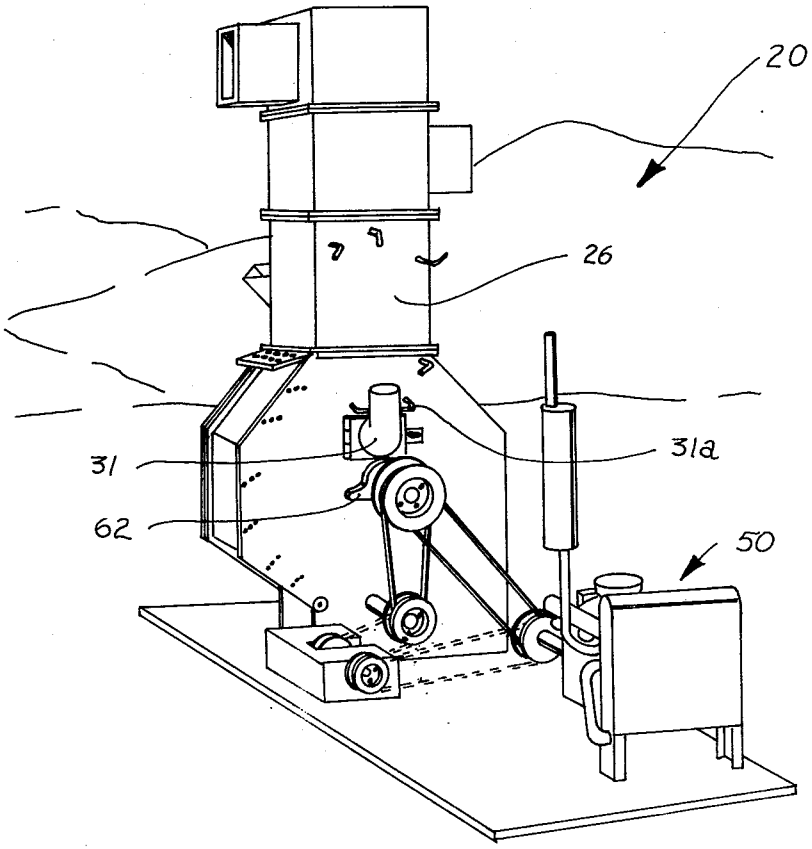
FIG. 2 is a perspective view of a mill as shown in FIG. 1, but with another type of housing.
Figure 3:
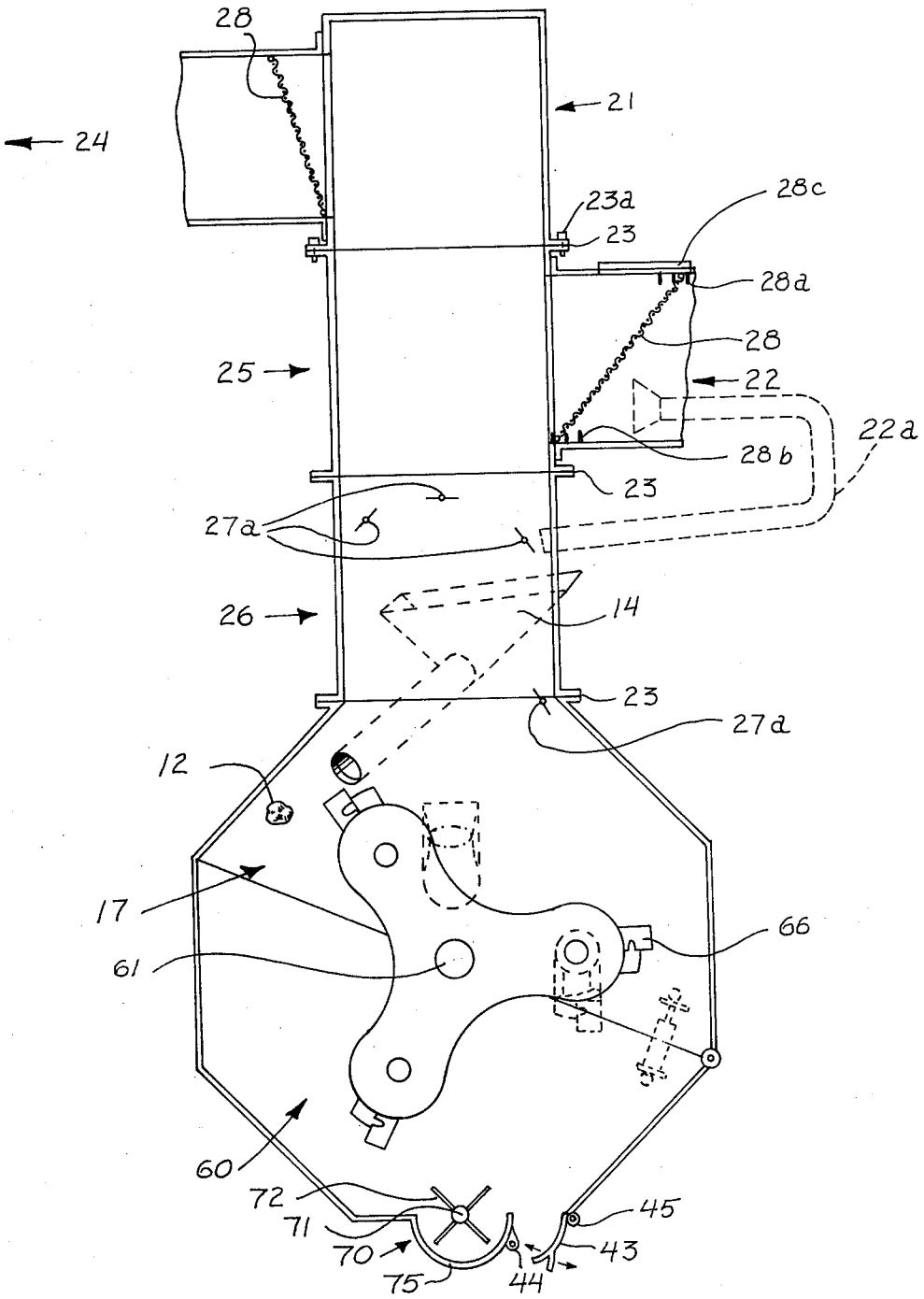
FIG. 3 is a front cross section of the interior of the mill shown in FIG. 1, showing in phantom a built in hydraulic jack.
Figure 8:
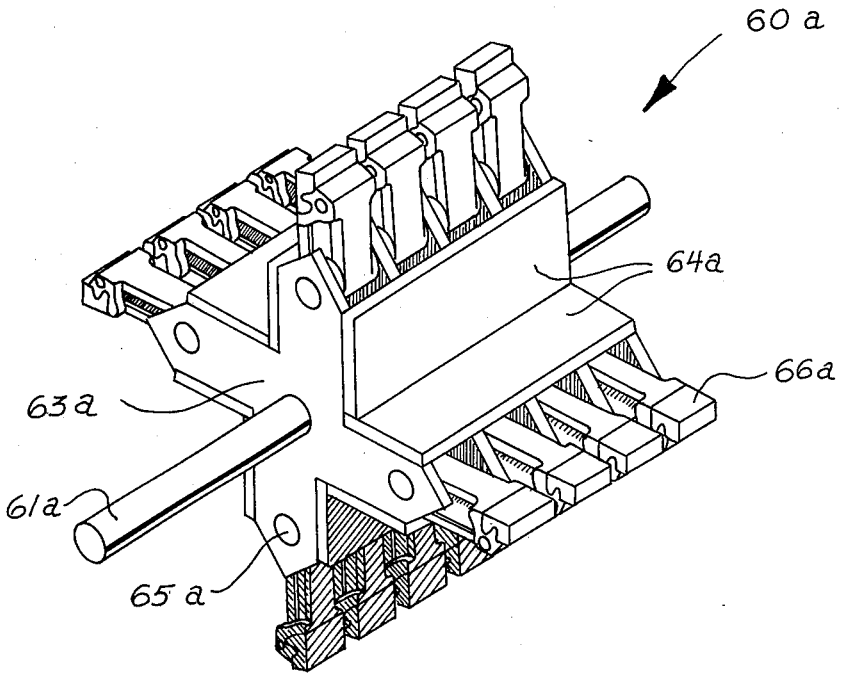
FIG. 8 is an exploded perspective view of an alternative impact rotor.
Figure 7A:
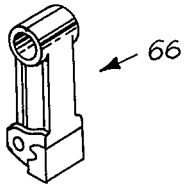
FIG. 7*a* is a perspective view of the hammer used in this mill.
Figure 7:
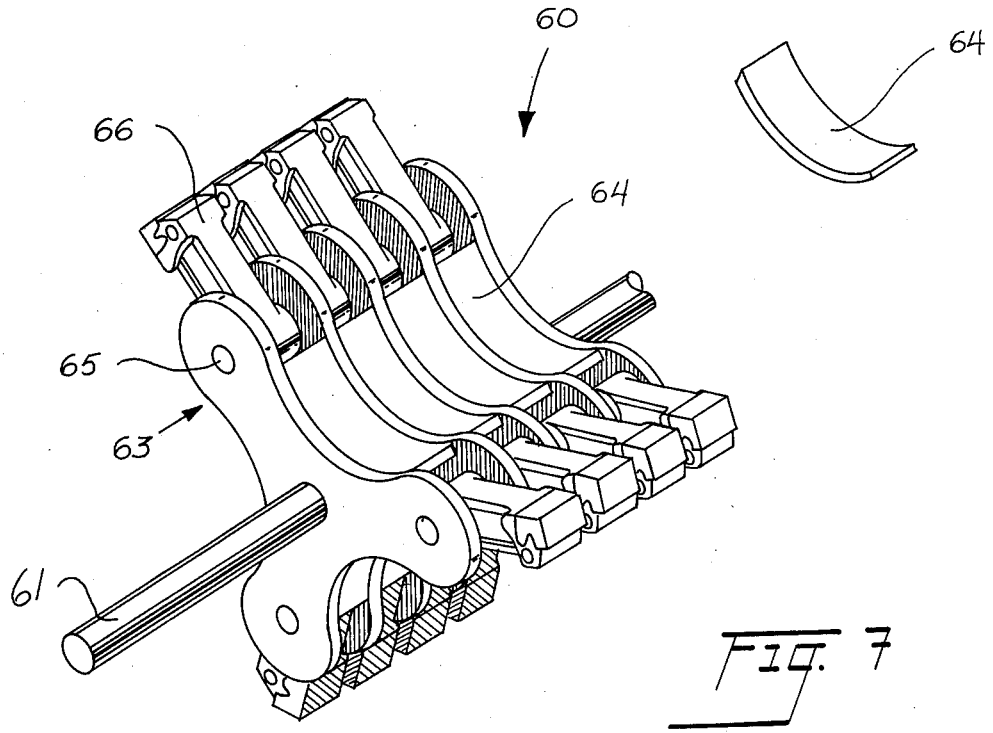
FIG. 7 is an exploded perspective view of an impact rotor used in the mill with element 64 shown additionally in perspective to the right of the figure; and displaying a break away perspective view of a rotor plate.

Referring now to the drawing and particularly to FIGS. 1, 2 and 3, there is illustrated the rotary mill 20. Mounted interiorly of the housing outer wall 41 is an impact rotor 60. The rotor is carried on a shaft 61 which extends transversely across the housing outer wall 41 and penetrates the housing and is carried on bearings 62. In reference to FIG. 6, the impact rotor 60 comprises a plurality of blades 63 and plates 64. The blades and plates are affixed to shaft 61 to increase the strength and rigidity of the unit. Blades 63 are penetrated at their periphery by bores. The bores in adjacent discs are in alignment to receive a removable shaft 65. Commercial hammers 66, such as Esco 802-B-1, as manufactured by Esco Corporation, 2141 NW 25th Avenue, Portland, Oregon 97210, are inserted between blades 63 and held in place by removable shaft 65. FIG. 8 illustrates another style of an impact rotor 60*a* wherein the plates 64*a* and blades 63*a* are of a different shape as compared to 64 and 63. Parts 61*a*, 65*a*, and 66*a* would have the same function as 61, 65, and 66. The shape of blades 63 with the element 64 between each pair of blades forms a air rotor effect which highly contributes to the vertical air movement within the mill which is necessary for classification of particle sizes. This point will be more fully explained. In reference to FIGS. 1, 2 and 3, the impact rotor 60 is turned by drive motor 50 in the direction of the arrow to propel chunks and particles 12 falling from the feed chute 14, shown in phantom, under the influence of gravity. It has been found that tangential feed is important for the reduction of wear on the hammers. Tangential feed is accomplished by adjusting feed chute 14 so that material entering the mill will do so on a tangent to the direction of the hammer movement in a downward mode.

Figure 6A:
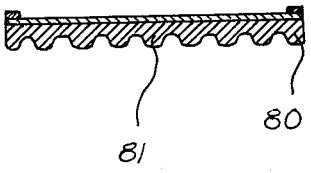
FIG. 6*a* is a top cross section of the lining plates of FIG. 6.
Figure 6:
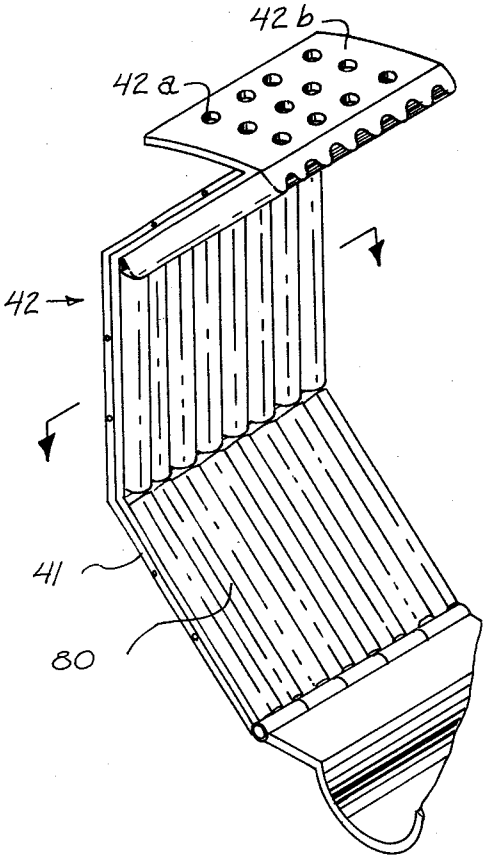
FIG. 6 is an exploded perspective view of the adjustable wall of FIG. 5.

In the impact reduction chamber 17 there is mounted a plurality of lining plates 80, see FIGS. 6 and 6*a*. Lining plates 80 have an undulating surface that forms u-shaped channel sections extending transversely of the housing outer walls 41 with their elongated vertical axes in parallelism with the rotational axis of the impact rotor 60. So positioned, the lining plates 80 present a plurality of apex proportions 81 to shatter the ore chunks and reduce the particle size. The lining plates 82 could be Easco 803-C as manufactured by Esco Corporation, 2141 NW 25th Avenue, Portland, Oregon 97210, type.

If the mill did not contain a fluidizing rotor unit 70, particles would collect on the trap door 43 until they built up to a sufficient extent that they would be swept, by contact with the hammers 66, and would be therefore fed into the stream of airflow. The access door 43 may be utilized for certain ore types, such as gold bearing ore to remove the concentrated ore. Removal is accomplished by swinging the latch portion 44 out of the interference with the door, thereby permitting it to swing free on the hinge 45.

An important feature of this mill is the direct cooperative effect between air velocity and classification of particle sizes. Due to the counter clockwise rotation of the impact rotor 60, particles will be propelled upward toward attrition chamber 26. This propulsion is somewhat caused by impact with the hammers but mostly by air flow which is directly controlled by impact rotor rpm and volume of air entering the air inlets 31. Note that a damper plate controlled by arm 31*a* can be adjusted to control the volume of inlet air. It should be further noted that air inlet 31 could be a venturi to also compliment intake air velocity.

Lighter particles will be lifted into upper classification chambers such as 21 while heavier particles will tend to resist the lifting action of the air flow and end up in lower classification chambers such as 25. It is even possible that larger particles will totally resist being lifted and continue to remain in the reduction chamber until the particle is reduced in size and finally lifted to a classification chamber. It is also possible that larger particles will strike the diverter plates 27*a* located in attrition chamber 26, and be deflected back into the path of the impact rotor. The diverter plates, FIG. 3, are positioned so that there is no straight line path from the discharge of the impact rotor to the upper classification chambers 25 and 21.

Some particles driven against the diverter plates are deflected back to the impact rotor with the assistance of gravity. The interchange between the impact rotor and diverter plates produces an autogenous attrition of the particles with the impacted larger particles being reduced by the finer particles contacted enroute to the attrition chamber, until the particles have reached a size that permits them to follow the circuitous path around the diverter plates under the influence of the air stream.

Each classification chamber has an outlet chute 22 (FIG. 3) connected by a flange and bolt fastening system in any one of the four directions of the rectangular chamber, generally 25, for example. This flange fastening system can comprise a number of bolts cooperative through holes in the flanges or other fastening means, such as clips, known to those skilled in the art. This feature will also reduce wear on any given side of the chamber with the ability to direct outlet chutes in various directions due to the fastening system described through the flanges 23 and bolts 23*a*. Also, the system can be used to recycle material through the reduction chamber by directing the outlet chute 22 to feed into chute 14 by means of an appropriate interconnecting channel 22*a* such as a pipe or other duct material. The advantage of this is that it may be desired, from time to time, to change the basic screen size (screen 28) and, thus, by recycling a smaller size could be obtained for material already passing through the system. Additionally, more materials passing into the stream, in the event there were few particles of the proper size, have a tendency to abrasion and, thus, to increase the amount of material passing the screen.

Each outlet chute contains a screen 28 which can further select particle size thereby excluding particle sizes which are slightly larger than desired. The screen is found to be most effective when it is positioned precisely transverse to the airflow from the impact reduction chamber and therefore a plurality of adjustment stops 28*a* are provided together with a lower screen rest 28*b* with a plurality of positions. By selecting between the positions on the screen rest 28*b* and adjustment stops 28*a* it is possible to position a screen 28 for maximum transversity to the then occurring airflow. A screen access door 28*c* is necessary so that the screen may be removed and replaced readily.

Also, an additional outlet could be connected from the top classification chamber to a source of suction 24 and/or to a dust deposit chamber.

On each side of the mill there is an air inlet tube 31 which contains a damper control 31*a* to control the volume of air entering the mill. If desired, the air inlet could be of a venturi type construction so that air velocity could also be controlled. Note that the air inlets 31, only one is shown, are housed in an access door 32 for accessibility to the air inlet and also to the interior of the mill.

It has been found, however, that there is a tendency for material to pack in the area of the primary reduction chamber which is directly below the impact rotor. The flow of air through the air inlets 31 helps to relieve this tendency to pack and causes the material to flow properly and to then proceed through the complete disintegration as heretofore described.

FIG. 3 illustrates a fluidizing rotor unit 70 which is located in a well 75 directly below the impact rotor 60. As previously mentioned, material has a tendency to pack in the well area and this is why the fluidizing unit is so positioned. The fluidizing rotor unit is simply a shaft 71 which has removable bars or fins 72 attached thereto, the removable bars or fins paralleling the length of the shaft.

The fluidizing rotor unit is driven by drive motor 50 via belts 52 and 53. In this configuration the impact rotor 60 and the fluidizing rotor 70 rotate in the same direction. After use, the bars or fins 72 will wear on the side where impact takes place and by reversing the direction of rotation of the fluidizing rotor, it is possible to expose the opposite sides of the bars or fins thereby extending the time of use. Reversal is possible in different ways. Pulleys 61*a*, 71, FIG. 1 could, when considering a twisted belt as compared to a straight belt rotate the fluidizing unit in the opposite direction. Also, a reversible drive gear box assembly 51 could be used in conjunction with belts 54, 55 shown in phantom, then by removing belt 52. If it were necessary to rotate the impact rotor in the opposite direction, belt 52 could be eliminated while belts 54, 55 and 53 would be used. Naturally, reversing the direction of rotation of the drive motor, or twisting of belt 52 would also suffice. Being able to reverse direction of rotation of the fluidizing unit is desired.

Figure 4:
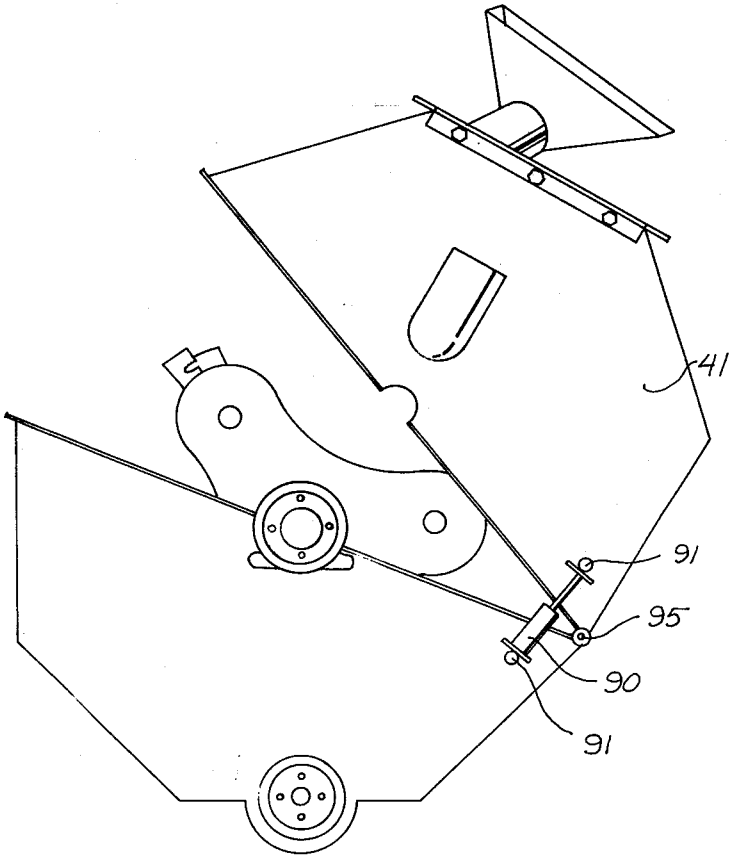
FIG. 4 is a partial crosss section of a front view of the mill of FIG. 1 showing the impact chamber in an open position.

FIG. 4 displays an advancement in the art wherein built in hydraulic jacks 90, only one is shown, are used to open housing 41 to gain unlimited access to the interior of the impact chamber. Special attachments 91 will allow for angular adjustments as the housing opens and closes about hinge unit 95.

Figure 5:
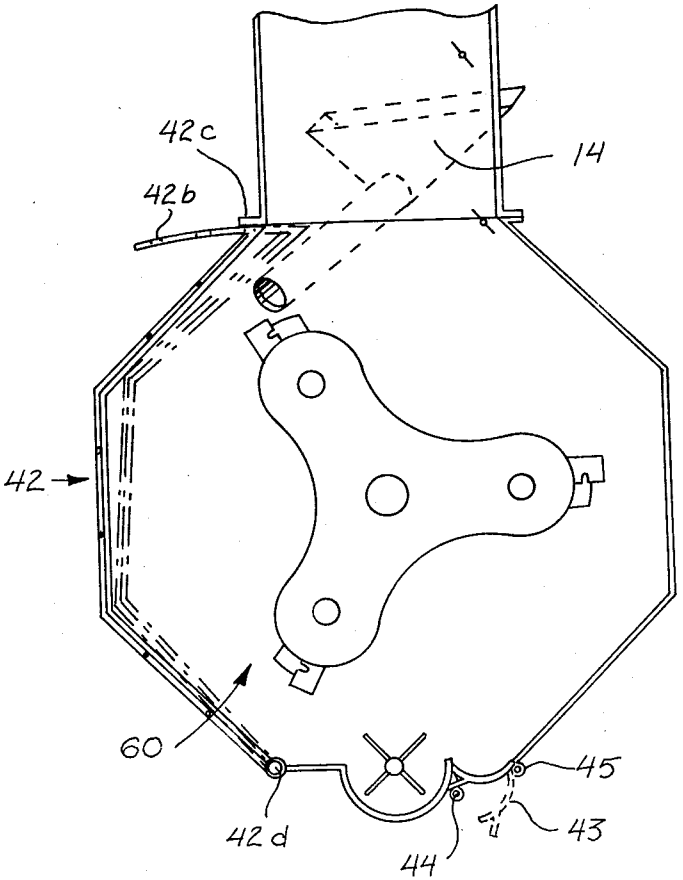
FIG. 5 is a front cross section of the mill of FIG. 2, showing the adjustable side wall.

FIGS. 5, 6 and 6*a* show the ability to adjust wall 42 in reference to distance between the lining plates 80 and the impact rotor 60. It is an advancement in the art to be able to select the desired clearance for the greatest efficiency in reduction of certain sizes and types of materials. Wall 42 can be adjusted inward or outward in a pivotal relationship about hinge 42*d*. Plate 42*b*, through a series of holes 42*a*, can be fastened to flange 42*c* when the wall is in the desired position.

While the embodiment of this invention, shown and described, is fully capable of achieving the objects and advantages desired, it is to be understood that the embodiments shown have been for purposes of illustration only, and not for purposes of limitation.

I claim:

1. An impact attrition mill, comprising:

a closed horizontally disposed octagon-shaped reduction chamber having a motor driven impact rotor concentrically mounted within to provide an intake space at one side and adjacent the top of the chamber, the rotor having radially extending vanes and rotating toward and down through the intake space;

access door means located in the bottom of the reduction chamber;

a gravity feed intake chute disposed above the primary reduction chamber and communicating therewith to supply material tangentially onto the top of the rotor and to the intake space;

a plurality of lining plates disposed within the primary reduction chamber opposite the rotor adjacent the receiving space and positioned so that ore particles will be flung by the rotor against the lining plates;

an attrition chamber located in a direct vertical line above the primary reduction chamber on the side opposite the ore receiving space and communicating with the reduction chamber to receive the flow of particles from the lining plates and containing means obstructing a straight line passage of particles from the impact chamber through the attrition chamber to a particle classification chamber with outlet means.

2. The impact attrition mill of claim 1 wherein the impact reduction chamber housing comprises a cooperative top and bottom section and the drive motor shaft is located on a horizontal plane where the top and botton section meet; hinging means on the side of the housing fartherest away from the lining plates; locking means where the top and bottom sections meet; and, built in hydraulic jack means to open and close the housing in a jaw like fashion.

3. The impact attrition mill of claim 1 wherein the reduction chamber contains an external air source means with an obstruction adjustment.

4. The improvement in a mill for the crushing, milling and classification of materials comprising the combination with a housing and a rotor and drive motor of the following: an octagonal shaped reduction chamber within said housing having access door means located in the lower portion of said chamber; an impact rotor connected to the said motor concentrically mounted within said reduction chamber in such a position that upon rotation of said rotor an airflow is produced directionally from an intake chute disposed above the octagonal reduction chamber and communicating therewith in such manner as to supply materials tangentially to the top of the rotor, through said reduction chamber to a particle classification chamber having outlet means; a plurality of impact means mounted upon said rotor, extending outwardly from the periphery of said rotor; an attrition chamber located in a direct vertical line above said reduction chamber and in a direct vertical line below said particle classification chamber; deflector plates within said attrition chamber, obstructing a straight line passage of particles from said reduction chamber to said particle classification chamber outlet means; a plurality of lining plates on the walls of the octagonal reduction chamber, said lining plates being so positioned as to provide impingement surfaces for particles driven by said impact rotor, the vertical axis of said plates being parallel with the axis of said impact rotor; air intake means located within the reduction chamber; and a second rotor unit located in the lower portion of the reduction chamber, the second rotor unit being driven by the mill drive motor through a shaft located below and paralleling the impact rotor; and removable bars paralleling the length of the shaft, wherein the second rotor unit prevents particles from accumulating at the lower portion of the reduction chamber, and wherein the reduction chamber includes cooperative top and bottom sections, and hinge means on the side of the housing whereby the sections may be opened and closed by means of a hydraulic jack means connected thereto; and locking means to hold said sections in position.

5. The mill of claim 4 wherein said air intake is located within the octagonal reduction chamber.

* * * * *